US007334999B2

(12) United States Patent
Aumont et al.

(10) Patent No.: US 7,334,999 B2
(45) Date of Patent: Feb. 26, 2008

(54) TURBOMACHINE ROTOR INCLUDING AT LEAST ONE DISK REINFORCED BY A COMPOSITE RING

(75) Inventors: Caroline Aumont, Paris (FR); Sandrine Chatel, Vaux le Penil (FR); Bruno Jacques Gerard Dambrine, Le Chatelet en Brie (FR); Didier Rene Andre Escure, Nandy (FR); Jean-Francois Fromentin, Cesson la Foret (FR); Jean-yves Guedou, Le Mee sur Seine (FR); Ludovic Edmond Camille Molliex, Brunoy (FR); Stephane Rousselin, Hericy (FR)

(73) Assignee: Snecma, Paris (FR)

( * ) Notice: Subject to any disclaimer, the term of this patent is extended or adjusted under 35 U.S.C. 154(b) by 0 days.

(21) Appl. No.: 11/427,106

(22) Filed: Jun. 28, 2006

(65) Prior Publication Data

US 2007/0086896 A1 Apr. 19, 2007

(30) Foreign Application Priority Data

Jun. 29, 2005 (FR) ..... 05 06629

(51) Int. Cl.
*F01D 5/02* (2006.01)

(52) U.S. Cl. ..... 416/248

(58) Field of Classification Search ..... 416/248; 415/216.1

See application file for complete search history.

(56) References Cited

U.S. PATENT DOCUMENTS 3,966,523 A * 6/1976 Jakobsen et al. ..... 156/169
4,397,609 A * 8/1983 Kochendorfer ..... 416/214 R
4,782,992 A 11/1988 Doble
4,787,820 A * 11/1988 Stenneler et al. ..... 416/95
4,867,644 A * 9/1989 Wright et al. ..... 416/230
4,919,594 A 4/1990 Wright et al.
5,305,520 A 4/1994 Doorbar et al.
5,470,524 A 11/1995 Krueger et al.
2003/0233822 A1* 12/2003 Albrecht et al. ..... 60/39.091

FOREIGN PATENT DOCUMENTS

DE 70 33 020 4/1972
WO WO 2005/065002 7/2005

OTHER PUBLICATIONS

A. Hirose, et al., "Joining Processes for Structural Applications of Continuous Fiber Reinforced MMCs", Key Engineering Materials, vol. 104-107, 1995, pp. 853-872.

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A turbomachine rotor including at least one disk having a ring constituted, for example, by a winding of metal-coated silicon carbide or alumina yarn. According to the invention, the composite ring is received in a closed annular cavity, e.g. defining by machining a groove in an enlarged portion of the disk and closing the groove by means of an annular plate after the ring has been put into place.

23 Claims, 2 Drawing Sheets

TURBOMACHINE ROTOR INCLUDING AT LEAST ONE DISK REINFORCED BY A COMPOSITE RING

The invention relates to a turbomachine rotor constituted by a plurality of disks assembled side by side on a common axis, each disk carrying a series of blades that are regularly distributed circumferentially, at least one of the disks being provided with a ring of composite material mounted at its radially innermost portion. The invention relates more particularly to an improvement seeking to integrate such a ring.

BACKGROUND OF THE INVENTION

US patent application No. 2003/0233822 describes a rotor of the above-mentioned kind including at least one disk provided at its radially innermost portion with a composite ring. Such a ring may be constituted, for example, by a winding of a strong yarn (e.g. of silicon carbide) embedded in a metal matrix. For example, it is known to fabricate such a ring by continuously coating a silicon carbide yarn in a titanium coating and forming a winding from such a coated yarn.

According to the above-mentioned document, various types of assembly can be envisaged between the ring and the disk. Some require giving a special shape to the radially innermost portion of the disk in order to serve as a base for the ring that is secured laterally. Under all circumstances, assembly implies that the metal of the disk and the metal of the ring matrix are identical.

OBJECTS AND SUMMARY OF THE INVENTION

The invention relates to an improvement enabling the ring to be better integrated in the structure of the disk.

More particularly, the invention provides a turbomachine rotor provided with at least one disk including a composite ring arranged at the radially innermost portion of the disk, wherein said ring is housed in a closed annular cavity formed in an enlarged portion of said disk, in the form of a hub, and in that said annular cavity is formed by an annular groove machined in said enlarged portion and closed by an annular metal plate after said ring has been put into place. Such a "hub" is conventionally to be found at the radially innermost portion of the disk.

The invention also provides a rotor disk, as such, presenting those characteristics.

This integration of the ring inside the "hub" of the disk is advantageous since it is no longer necessary for the metal matrix of the ring to be of the same metal as the disk.

For high temperatures, it is necessary for the disk to be made of a nickel-based alloy. However, it is not possible at present to envisage making the composite ring with a nickel-based alloy. The invention serves in particular to overcome this difficulty since it suffices to insert the ring in the annular cavity provided to receive it, and then to close the cavity.

The invention also provides a method of making a metal rotor disk presenting an enlarged portion in the form of a hub, the method consisting:

in forming an annular groove in said enlarged portion, said groove being centered on the axis of rotation of said disk and opening out laterally into one side thereof;

in fabricating separately and in conventional manner a ring of composite material having the dimensions of said groove;

in placing said ring in said groove; and in closing said groove by means of an annular metal plate and in securing it to said enlarged portion.

It is also possible to proceed with brazing the ring inside the groove using an appropriate brazing material that is compatible with the two metals, and that is presented in the form of a powder, for example. The powder is introduced into the cavity together with the ring and brazing can occur automatically during a subsequent operation of hot isostatic compacting of said disk.

Concerning assembling the annular plate, it is preferable for this plate to be welded to said enlarged portion. The welding may advantageously be of the type making use of an electron beam in a vacuum.

Concerning the ring itself, it may be made in the form of a winding of silicon carbide yarn coated in a metal base. By way of example the metal base may be a titanium alloy. It is also possible to replace the silicon carbide yarn by an alumina yarn.

After the annular plate has been secured, a hot isostatic compacting operation may be applied to said disk. Amongst other advantages, this treatment serves to distribute stresses in the welding between said enlarged portion and the annular plate, thereby improving closure of the groove.

The part is finished off by conventional finishing machining.

By way of example, the ring of composite material may be winding a silicon carbide yarn, by embedding said yarn in a titanium-based alloy. The TI6242 alloy is suitable for operating temperatures of about 450° C.

The composite portion made in this way presents mechanical characteristics that are significantly better than those of the metal base material. The ring may be integrated in the annular cavity formed in said enlarged portion in the form of a hub. The disk may be made of a nickel-based alloy (e.g. INCO718).

The invention enables the composite ring to be placed as close as possible to the axis of rotation in order to optimize its effectiveness. Since the ring is placed at a small radius, the maximum temperature it reaches is less than 300° C., whereas the temperature of the rim (level with the hot gas stream) is greater than 600° C.

For example, a comparison has been made between the characteristics obtained with the invention for designing a stage 5 disk of a low pressure compressor in a turbojet, having a composite ring of the kind described above integrated in an enlarged portion made of "INCO718". The weight of the disk with a composite ring was 75 kilograms (kg) instead of 137 kg for a disk that is made entirely out of metal.

More generally, it is possible to install a composite ring of matrix X in the cavity of the disk of material Y providing the materials are compatible with each other. Where necessary, a covering of material Z, different from X and Y, may be interposed around the composite ring in order to ensure compatibility between the material pairs X-Z and Z-Y, respectively.

BRIEF DESCRIPTION OF THE DRAWINGS

The invention can be better understood and other advantages thereof appear more clearly in the light of the following description given purely by way of example and made with reference to the accompanying drawings, in which.

MORE DETAILED DESCRIPTION

Figure 1:
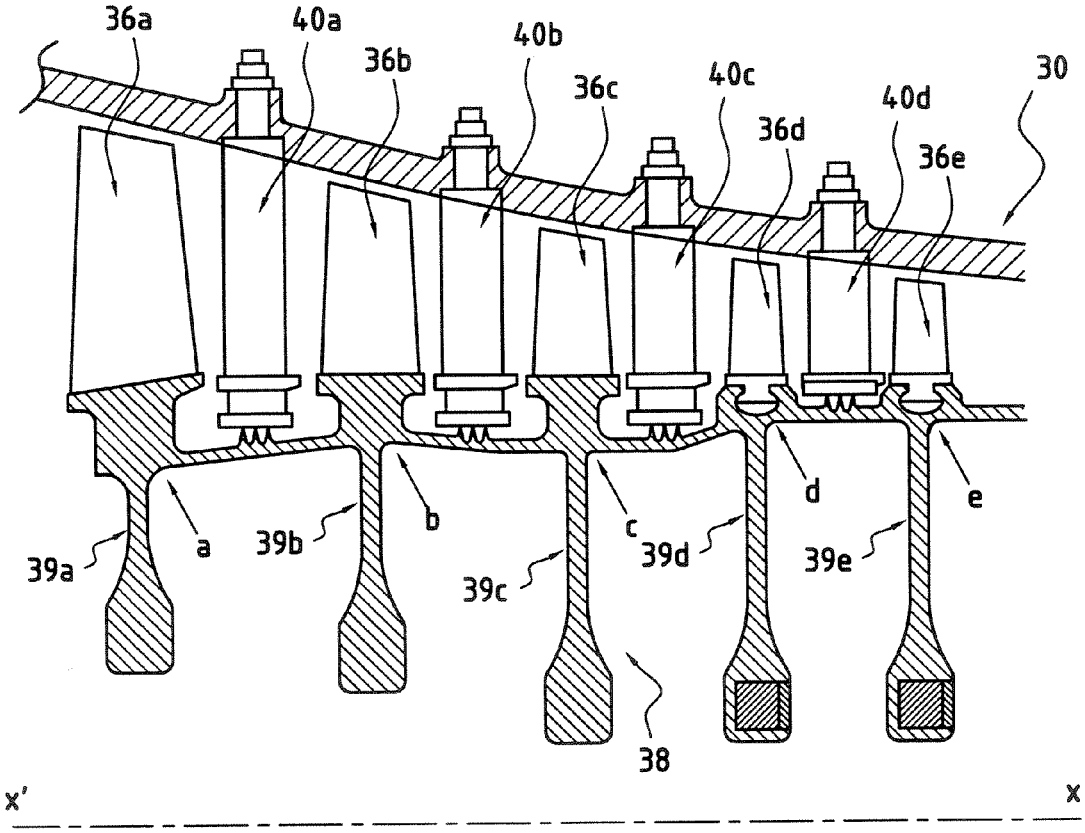
FIG. 1 is a fragmentary half-section of a low pressure compressor for a turbojet, including a rotor of the invention.

FIG. 1 shows a portion of the compressor 30 comprising a casing 32, a rotor 34 having an axis of rotation X-X, and presenting five stages a-e of moving blades 36*a*-36*e* mounted at the periphery of means 38 constituted by a side-by-side assembly of disks 39*a*-39*e*.

Stationary vanes 40*a*-40*d* are mounted between the stages of moving blades, in the passage 42 for passing the stream of hot gas.

The above-described arrangement is conventional. The improvement of the invention can be applied to any of the disks, but it is preferably applied to the disks of the later stages, e.g. d and e, as shown.

Figure 2:
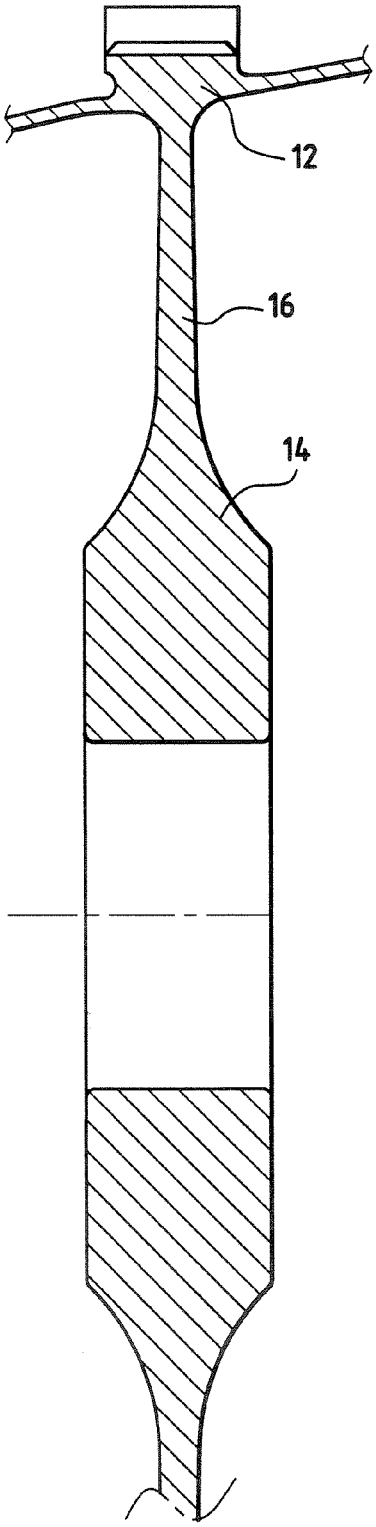
FIG. 2 is a diagrammatic radial section through a rotor disk suitable for receiving the improvement of the invention.

FIG. 2 is a diagram of a conventional rotor disk 11 mainly constituted by a rim 12 carrying external blades (not shown), a relatively thin annular web 13, and an enlarged portion 14 in the form of a hub that is situated as close as possible to the axis of rotation X.

In the conventional technique, such a rotor disk carrying a moving blade stage is made out of a single metal, e.g. a titanium alloy, or a nickel alloy if the temperature reached by this level of the rotor makes that justified.

It is this conventional structure that is modified in accordance with the invention in order to insert a composite ring therein, e.g. a ring of SiC/Ti. To do this, a closed annular cavity is defined in the enlarged portion 14.

Figure 3:
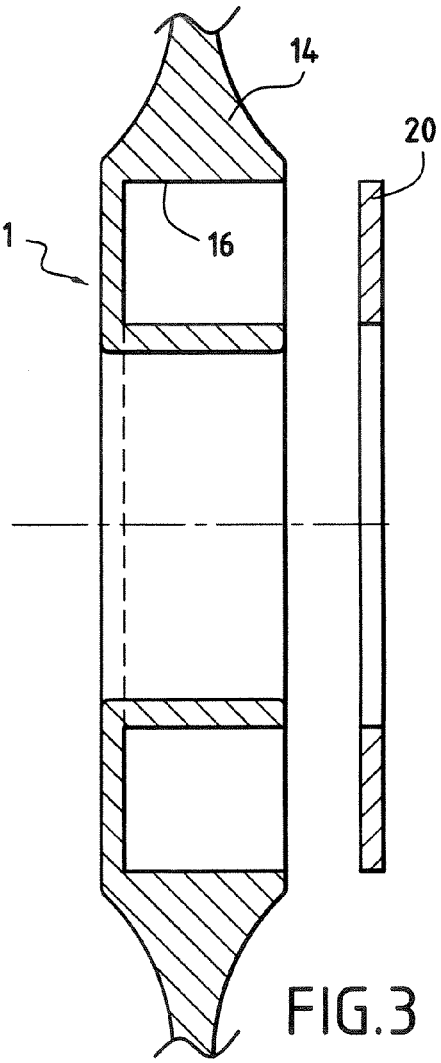
FIGS. 3 to 5 show three successive steps in implementing the method of the invention.

In a first step (FIG. 3), a groove 16 is machined in said enlarged portion 14. The opening to said groove extends over a lateral surface that is perpendicular to the axis rotation X. Naturally, this groove may be machined in a blank that is already provided with a hollow annular portion, with the machining serving merely to give the groove its final shape and dimensions corresponding to the dimensions of a composite ring 18 that is fabricated separately, as described below, and that constitutes a winding 19 of a silicon carbide yarn embedded in a titanium-based alloy 21.

An annular plate 20 is also cut out; it is made of the same metal as the disk. Its dimensions are selected so that it is suitable for closing the groove 16, fitting along the inside and outside edges thereof.

Figure 4:
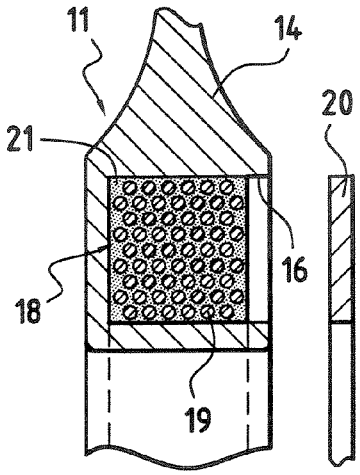

The composite ring 18 is placed (FIG. 4) in the groove 16, possibly together with a brazing powder that is compatible with the metal of the disk and with the metal of the matrix of the ring also being introduced.

Figure 5:
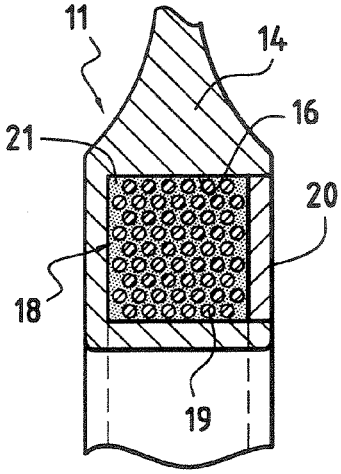

Thereafter (FIG. 5), the annular plate 20 is put into place to close the cavity and it is secured to said enlarged portion. As mentioned above, the annular plate may be secured by means of a weld implemented using an electron beam in a vacuum.

The operations may be finished off by hot isostatic compacting and final machining.

What is claimed is:

1. A turbomachine rotor including at least one disk provided with a composite ring arranged at the radially innermost portion of the disk, wherein said composite ring separately formed is housed in a closed annular cavity formed in an enlarged portion of said disk, in the form of a hub, and wherein said annular cavity is formed by an annular groove machined in said enlarged portion laterally on one side thereof and closed by an annular metal plate that covers said composite ring in said annular groove, said annular metal plate fitting along inside and outside edges of said annular groove and being welded to said inside and outside edges.

2. A rotor according to claim 1, wherein said composite ring comprises a winding of metal-coated silicon carbide yarn.

3. A rotor according to claim 2, wherein said metal is a titanium-based alloy.

4. A rotor according to claim 1, wherein said composite ring comprises a coil of metal-coated alumina yarn.

5. A rotor according to claim 1, wherein said ring is brazed in said annular groove.

6. A rotor disk including an annular ring arranged at the radially innermost portion of the disk, wherein said annular ring separately formed is housed in a closed annular cavity formed in an enlarged portion of said disk, in the form of a hub, and wherein said annular cavity is formed by an annular groove machined in said enlarged portion laterally on one side thereof and closed by an annular metal plate that covers said annular ring in said annular groove, said annular metal plate fitting along inside and outside edges of said annular groove and being welded to said inside and outside edges.

7. A disk according to claim 6, wherein said annular ring comprises a winding of metal-coated silicon carbide yarn.

8. A disk according to claim 7, wherein said metal is a titanium-based alloy.

9. A disk according to claim 6, wherein said annular ring comprises a coil of metal-coated alumina yarn.

10. A disk according to claim 6, wherein said ring is brazed in said annular groove.

11. A method of making a metal rotor disk presenting an enlarged portion in the form of a hub defined in its radially innermost portion, the method comprising:

forming an annular groove in said enlarged portion, said annular groove being centered on the axis of rotation of said disk and opening out laterally into one side thereof;

fabricating separately a composite ring having the dimensions of said annular groove;

placing said composite ring in said annular groove; and closing said annular groove with an annular metal plate fitting along inside and outside edges of said annular groove, and welding said annular metal plate to said inside and outside edges.

12. A method according to claim 11, wherein said composite ring is brazed in said cavity after said composite ring has been put into place therein.

13. A method according to claim 11, wherein said annular metal plate is assembled to said enlarged portion by welding.

14. A method according to claim 13, wherein said welding comprises using a beam of electrons in a vacuum.

15. A method according to claim 11, further comprising, after said annular metal plate has been welded, hot isostatic compacting said disk.

16. A turbomachine rotor comprising:

a disk having an inner enlarged portion defining a annular groove having an opening extending over a lateral surface of said disk, said lateral surface being perpendicular to an axis of rotation of said turbomachine rotor;

a composite ring inside said annular groove; and a flat annular metal plate configured to close said opening of said annular groove so as to cover said composite ring inside said annular groove, said flat annular metal plate being secured to said disk at the periphery of edges of said annular groove.

17. A rotor according to claim 16, wherein said disk defines a single annular groove, and said rotor includes a single composite ring inside said single annular groove, and further includes a single flat annular metal plate that covers said single composite ring inside said single annular groove.

18. A rotor according to claim 16, wherein said disk defines a single annular groove that opens only on said lateral surface, and does not open on another surface of said disk.

19. A rotor according to claim 16, wherein said flat annular metal plate is not secured to said disk at the periphery of said disk.

20. A rotor according to claim 16, wherein said flat annular metal plate is of a same metal as said disk.

21. A rotor according to claim 16, wherein said composite ring comprises a yarn embedded in a titanium-based alloy and said disk comprises a nickel-based alloy.

22. A rotor according to claim 16, wherein said disk further comprises a annular web between said inner enlarged portion and a blade, wherein said annular web is thinner than said inner enlarged portion, and wherein said annular groove and said composite ring are confined to said inner enlarged portion and do no extend into said annular web.

23. A rotor according to claim 16, wherein said disk is a first disk and said rotor further comprises a second disk, wherein said first disk is part of a later stage than said second disk, wherein said second disk is free of any composite ring, wherein said second disk has an inner enlarged portion that is further away from said axis of rotation than said composite ring of said first disk.

* * * * *